US006776505B1

(12) United States Patent
DeWitt

(10) Patent No.: US 6,776,505 B1
(45) Date of Patent: Aug. 17, 2004

(54) ILLUMINATED IMAGE NIGHT LIGHT

(76) Inventor: Shane DeWitt, 2693 Bancock St., Simi Valley, CA (US) 93065

( * ) Notice: Subject to any disclaimer, the term of this patent is extended or adjusted under 35 U.S.C. 154(b) by 0 days.

(21) Appl. No.: 10/265,305

(22) Filed: Oct. 4, 2002

(51) Int. Cl.[7] ..... F21V 21/00

(52) U.S. Cl. ..... 362/249; 362/219; 362/226; 362/235; 362/800; 40/416

(58) Field of Search ..... 362/226, 812, 362/800, 249, 235, 219; 40/714, 546, 715, 716

(56) References Cited

U.S. PATENT DOCUMENTS 4,549,250 A * 10/1985 Spector ..... 362/96
5,265,357 A * 11/1993 Yu ..... 40/714
5,555,654 A * 9/1996 Hermann ..... 40/714
5,899,012 A * 5/1999 Crum ..... 40/716
6,285,140 B1 * 9/2001 Ruxton ..... 315/312
6,351,904 B1 * 3/2002 Hermanson ..... 40/715
6,390,647 B1 * 5/2002 Shaefer ..... 362/276
6,394,623 B1 * 5/2002 Tsui ..... 362/249
2002/0133993 A1 * 9/2002 Mueller ..... 40/714

FOREIGN PATENT DOCUMENTS

GB 2097110 A * 10/1982 ..... F21V/1/00

* cited by examiner

*Primary Examiner*—Thomas M. Sember
(74) *Attorney, Agent, or Firm*—David O'Reilly

(57) ABSTRACT

An illuminated image night light comprised of a frame for mounting an image such as a picture or a photograph and a receptacle attached to the back of the frame for installing a high-intensity, low heat light source. The light source is preferably a rope light mounted in a serpentine fashion in the receptacle and spaced a short distance in the receptacle behind the image. The image is produced on a heat-resistant material such as cotton canvas or a polyester film. In an optional embodiment, illumination is provided by a plurality of LEDs in series mounted on a board attached to the inside back wall of the receptacle mounted on the back of the frame. The advantages of this illuminated image night light is that any picture, photograph or other type of image can be mounted in the frame and illuminated to provide an attractive display in a night light without fear of damage to the image.

11 Claims, 3 Drawing Sheets

ILLUMINATED IMAGE NIGHT LIGHT

BACKGROUND OF THE INVENTION

1. Field of the Invention

This invention relates to night lights and more particular relates to a night light comprised of an image in a frame illuminated by back light to provide a night light.

2. Background Information

Night lights come in a variety of forms. Some include illuminated images such as a standard night light having an image in a frame that attaches to a standard incandescent bulb.

One such device is disclosed and described in U.S. Pat. No. 5,622,424 of Brady issued Apr. 22, 1997. In this device, a standard night light having a plug for insertion in a socket has an opaque frame that includes a bayonet connection for snapping over an incandescent light acting as a night light.

A variety of other devices for providing night lights with displays are also available. However, many of these devices display either very crude images or are comprised of a diagram formed by a number of lights. The problem with these devices is the heat and radiation from the light can damage any image mounted in a frame, therefore, present devices are in the form of either small devices with a single bulb or devices that are illuminated around the frame. Light and heat generally cause a deterioration of images. Therefore, it is difficult to form a standard picture frame with an image that can be illuminated by a back light without causing damage to the image from heat or light.

BRIEF DESCRIPTION OF THE INVENTION

The purpose of the present invention is to provide an attractive image such as a photograph or picture that can be efficiently illuminated by a back light that can provide an attractive night light without causing damage to the image.

The present invention provides an attractive image in a frame illuminated by a back light that minimizes the presence of heat and potential damage to the image. The image can be illuminated for long periods without any damage. A receptacle is mounted on the back of a picture frame and has a light source behind an image or picture or photograph mounted in the frame. The illumination is provided in the form of a lighting known as a rope light which is a series of small lights mounted in a transparent tube. The rope light is mounted in a serpentine fashion in series in the receptacle and spaced from the rear of the image mounted in the frame.

The image is preferably produced on a heat-resistant material such as a 20 mil. cotton canvas having a semi-gloss finish. The image is printed on this material and can be illuminated from the rear to provide an attractive image and resists damage from heat or light. Further, the light rope provides substantial light without producing heat sufficient to damage the image. The image could also be produced on a reverse print film comprised of an 8 mil. polyester base with a quick dry defuser coating. Either of other materials is suitable for back lighting and providing an attractive image while at the same time resisting damage from the heat produced by the source of light.

The night light is in the form of a picture frame having a receptacle mounted on the back of the frame containing the source of light. This source of light can be a rope light as described above or, in the alternative, can be a series of light emitting diodes mounted on a board that fits into the receptacle behind the frame. Electrical power to the light source is provided by an electrical cord having a plug for connecting the light source to 120 volt AC power source. An in-line switch turns the light source on and off. In an alternate embodiment, the on/off switch can also include a dimmer for increasing or decreasing the amount of back light for the image in the frame.

The frame is designed so that the image, photograph or picture can be easily changed. The image can be processed on the material described above and can be a regular photograph, or any other image that is applied to the material. Together, the image and illumination provide a medium for displaying personal photographs or distinctive images to produce a very attractive display.

Preferable, the picture frame is made out of a durable synthetic material such as plastic. The plastic is preferred because it can be offered in a variety of colors including black, metallic bronze, or slate. Optionally, the frame can be manufactured in a plurality of sizes to accept images or photographs of 5×7, 8×10, or larger if desired.

It is one object of the present invention to provide a illuminated image in a frame which can function as a night light.

Yet another object of the present invention is to provide an illuminated image in a frame that has the image produced on a heat-resistant material for durability.

Still another object of the present invention is to provide an illuminated image in a frame having a light source which provides efficient illumination while minimizing the potential for heat damage to the image.

It is another object of the present invention to provide a night light with an illuminated image which can be a personal photograph or some other distinctive image that results in a very attractive display.

Yet another object of the present invention is to provide an illuminated image night light in which the image is easily changed.

The above and other objects, advantages, and novel features of the invention will be more fully understood from the following detailed description and the accompanying drawings, in which:

DETAILED DESCRIPTION OF THE INVENTION

Figure 2:
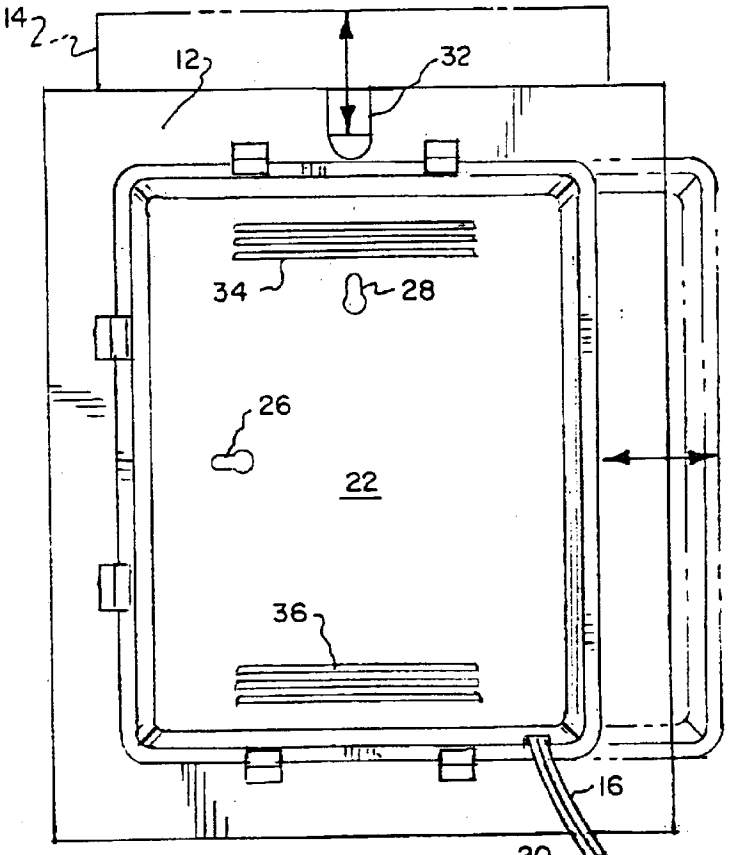
FIG. 2 is a rear view of the illuminated image night light of FIG. 1. FIG.
Figure 1:
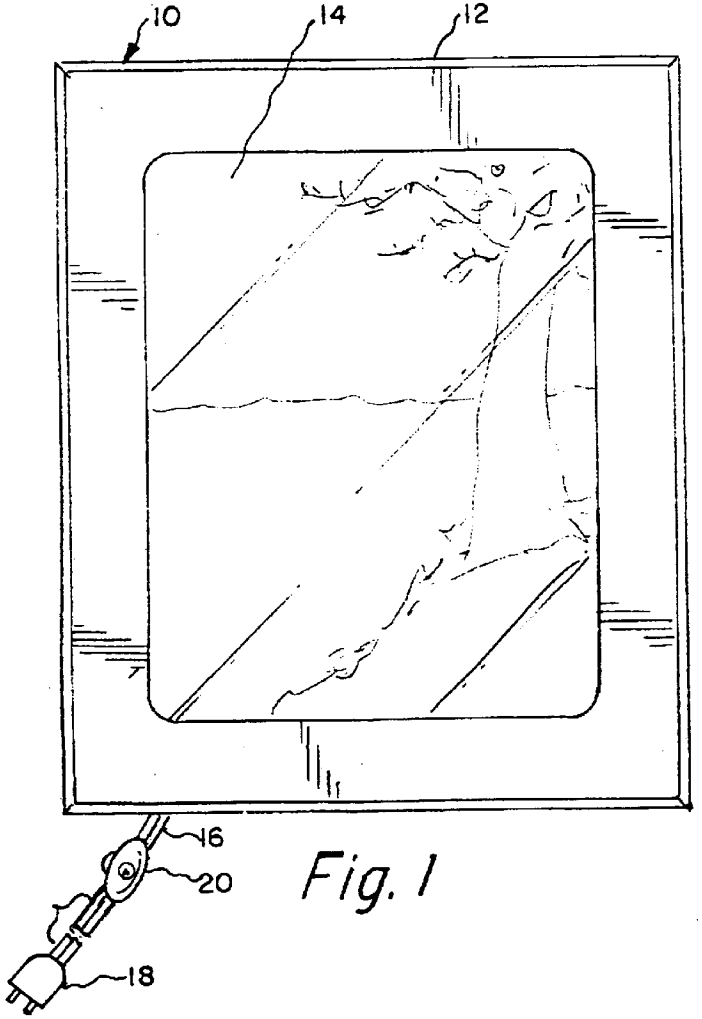
FIG. 1 is a front elevation of an illuminated image night light according to the invention.
Figure 3:
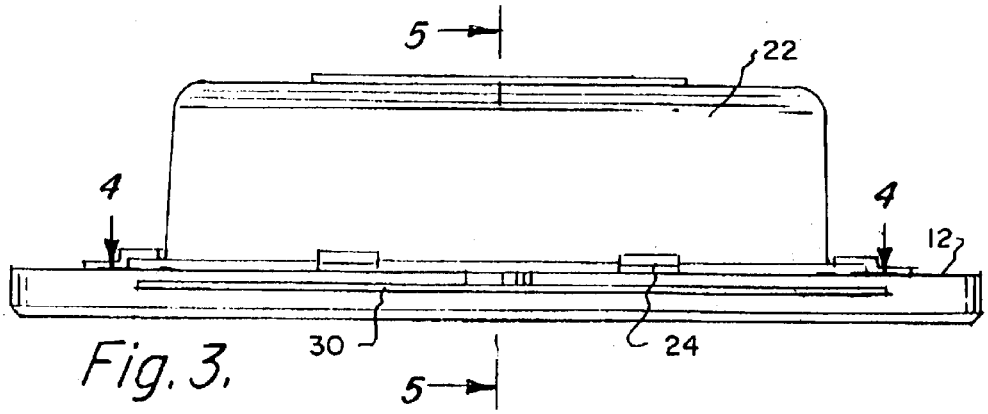
FIG. 3 is a top view of the illuminated image night light of FIG. 1.

An illuminated image night light is shown generally in FIGS. 1 through 3. Illuminated image night light 10 is comprised of a frame 14 having an image 14 which can be a photograph, a drawing, or any other type of image produced on a heat-resistant material as will be described in greater detail hereinafter. Power is provided by cord 16 having plug 18 for connecting to a source of 120 V AC power. Switch 20 turns a light source on and off and can include a dimmer if desired as will be described in greater detail hereinafter.

A receptacle 20 for housing a source of illumination is mounted on the rear of frame 12 and secured by clips 22 or any other suitable means. Frame 20 can be constructed of any suitable material but it is preferably made of a synthetic material such as plastic which can be molded allowing the frame to be produced in a variety of colors. The colors can be black, metallic bronze, slate, or any number of other colors.

Receptacle or box 22 also has key slots 26 and 28 for mounting the illuminated image night light on a wall or other suitable surface. The night light 10 can also be surface mounted in a stand if desired. The receptacle or box 22 also is mounted in clips 24 so that frame 20 can be slid off receptacle 22 allowing servicing of the light source or also allowing image 14 to be changed if desired. In addition, frame 12 has a slot 30 across the top and a second finger slot 32 for removing and replacing image 14. Thus, the image 14 in frame 12 can easily and quickly be changed by pulling it out of slot 30 with a finger in slot 32 and replacing it with another photograph or picture.

Receptacle or box 22 also has vents 34 and 36 for venting any heat collecting inside the receptacle.

Figure 4:
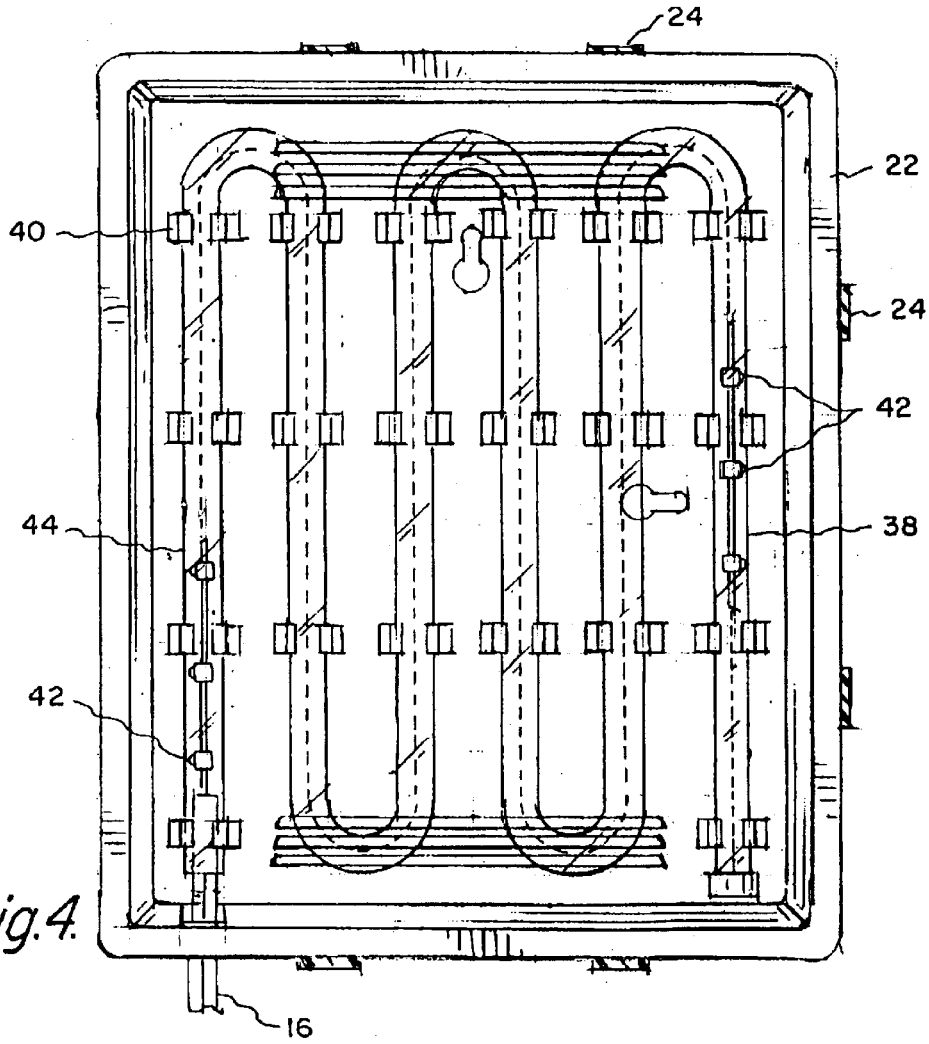
FIG. 4 is a sectional view taken at 4—4 of FIG. 3.

A light source for providing uniform low heat illumination is illustrated in FIG. 4. Light source 38 is in the form of a rope light mounted in a serpentine fashion to the rear of receptacle or box 22 by clips 40 or any other suitable means. Rope light 38 is a series of small lamps 42 inside a transparent flexible tube 44. Preferably rope light is a 10 amp rope light, Model No. DUR-NR2 130300 or DUR-2R2 130300 available from Horizon Lighting of Gresham, Oregon. Miniature bulbs 42 are on 1 inch or 2 inch spacing inside transparent flexible tube 44. Also, these rope lights can be in a variety of colors but for the purposes of a night light is preferably clear.

Figure 5:
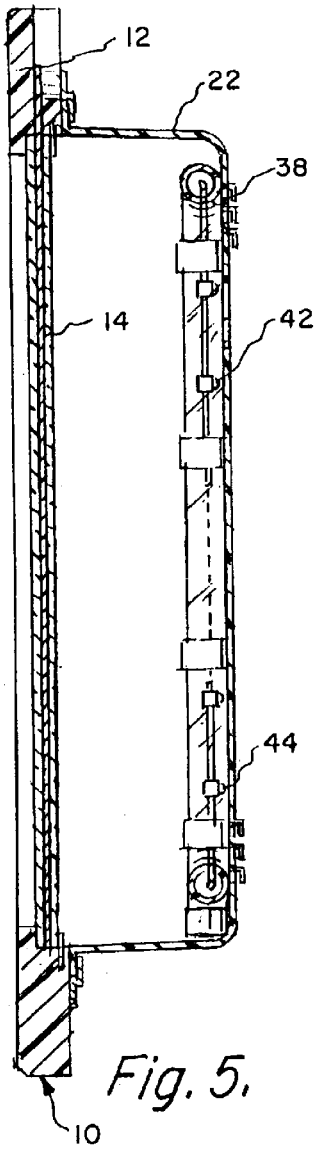
FIG. 5 is a sectional view taken at 5—5 of FIG. 3.

As shown in FIG. 5, rope light is mounted on the rear of receptacle 22 and is spaced one inch or slightly more behind image 14 mounted in frame 12. As described previously, power is provided by AC power cord 16 connected by plug 18 to 120 V AC source. Switch 20 turns rope light on and off and can include a dimmer to increase or decrease the intensity of light behind image 14 in frame 12.

Figure 6:
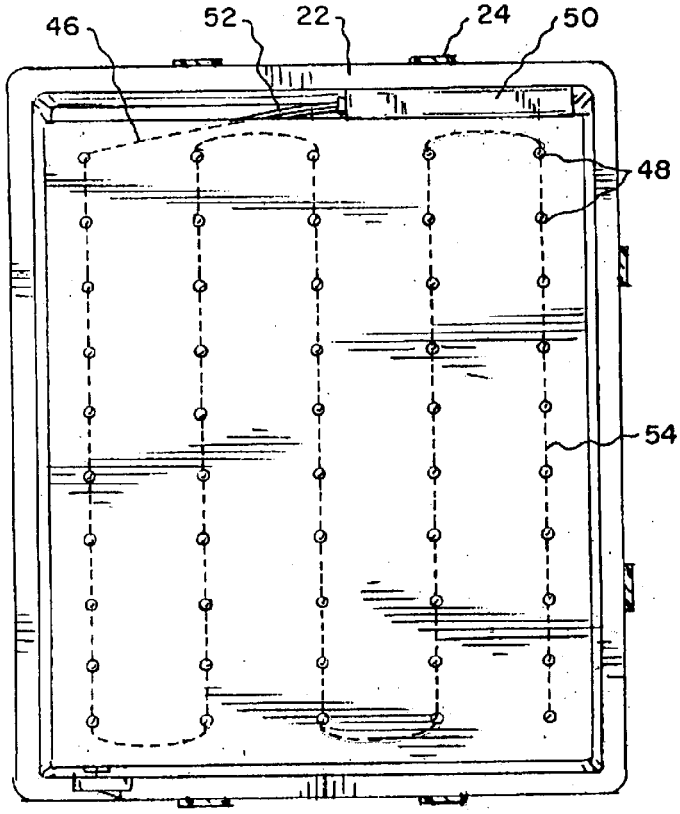
FIG. 6 is a sectional view similar to FIG. 4 illustrating the construction of an alternate light source.

An alternate embodiment is illustrated in FIG. 6. In this embodiment, board 46 is mounted in receptacle 22 and has a plurality of light emitting diodes (LEDs) 48 to provide illumination. Light emitting diodes 48 are mounted in rows and columns on board 46 and are connected in series to a power source. In this embodiment, an optional power source of battery 50 connected by cord 52 may be provided. The serpentine connection of LEDs 48 in series is illustrated by dotted line 54. Light emitting diodes 48 can be high-intensity diodes that provide bright illuminations such as those now available and used in traffic lights. These lights provide good illumination while radiating relatively low heat. This combination plus the spacing in receptacle or box 22 prevents damage to image 14 from heat being generated by the LEDs.

Thus, there has been disclosed a novel and unique, attractive, illuminated image night light that avoids the problems of previous devices. In one embodiment, the system includes a frame for mounting an image and a receptacle mounted on the back of the frame for mounting a rope light that provides good illumination while minimizing the heat. The image is produced on heat-resistant cotton canvas or on a polyester film. Personal photographs or distinctive images can be mounted in the frame to provide a night light with an attractive display.

This invention is not to be limited by the embodiment shown in the drawings and described in the description which is given by way of example and not of limitation, but only in accordance with the scope of the appended claims.

What is claimed is:

1. An image illuminating night light device comprising;

a frame;

a recess in said frame for mounting an image;

a receptacle mounted on the back of said frame behind said image;

a high intensity, low heat light source mounted in said receptacle behind said image;

said high intensity, low heat light source is comprised of a plurality lights connected in series inside a transparent tube;

said image being produced on a translucent heat resistant material; and a power source for illuminating said light source;

a switch for turning said light source on and off;

whereby said image in said frame serves as an attractive night light.

2. The device of claim 1 in which said low heat light source is mounted in said receptacle behind said image in a serpentine arrangement to provide even illumination behind said image.

3. The device of claim 1 including a slot in said frame to quickly and easily exchange said image.

4. The device of claim 3 in which said image is a photograph.

5. The device of claim 1 in which said heat resistant material comprises a semi-gloss cotton canvas.

6. The device of claim 1 in which said heat resistant material comprises a reverse print polyester base finish film.

7. An image illuminating night light device comprising;

a frame;

a recess in said frame for mounting an image;

a receptacle mounted on the back of said frame behind said image;

a high intensity, low heat light source mounted in said receptacle behind said image;

said high intensity, low heat light source is comprised of a plurality of light emitting diodes mounted in a series on a board in columns and rows to provide even illumination behind said image;

said image being produced on a translucent heat resistant material; and a power source for illuminating said light source;

a switch for turning said light source on and off;

whereby said image in said frame serves as an attractive night light.

8. The device of claim 7 including a slot in said frame to quickly and easily exchange said image.

9. The device of claim 6 in which said image is a photograph.

10. The device of claim 7 in which said heat resistant material comprises a semi-gloss cotton canvas.

11. The device of claim 7 in which said heat resistant material comprises a reverse print polyester base finish film.

* * * * *